US008082830B2

(12) United States Patent
Rummel et al.

(10) Patent No.: US 8,082,830 B2
(45) Date of Patent: Dec. 27, 2011

(54) FOOD PRODUCT SLICER AND ASSOCIATED INTERLOCK SYSTEM

(75) Inventors: Samuel Rummel, Pooler, GA (US); Brian Stump, Englewood, OH (US); Shiyu Chen, Richmond Hill, GA (US); Shahram Shariff, Savannah, GA (US)

(73) Assignee: Premark FEG L.L.C., Wilmington, DE (US)

( * ) Notice: Subject to any disclaimer, the term of this patent is extended or adjusted under 35 U.S.C. 154(b) by 587 days.

(21) Appl. No.: 12/281,492

(22) PCT Filed: Mar. 2, 2007

(86) PCT No.: PCT/US2007/063128

§ 371 (c)(1),
(2), (4) Date: Sep. 3, 2008

(87) PCT Pub. No.: WO2007/103766

PCT Pub. Date: Sep. 13, 2007

(65) Prior Publication Data

US 2009/0071310 A1 Mar. 19, 2009

Related U.S. Application Data

(60) Provisional application No. 60/780,423, filed on Mar. 8, 2006.

(51) Int. Cl.
*B26D 7/22* (2006.01)

(52) U.S. Cl. ..... 83/730; 83/707

(58) Field of Classification Search ..... 83/412, 83/703, 707, 714, 717, 730, 932
See application file for complete search history.

(56) References Cited

U.S. PATENT DOCUMENTS

| | | | | |
|---|---|---|---|---|
| 2,931,406 | A * | 4/1960 | Gilbert | 83/707 |
| 2,970,623 | A * | 2/1961 | Lundell | 83/703 |
| 4,397,206 | A * | 8/1983 | Czala | 83/399 |
| 5,615,591 | A * | 4/1997 | Scherch et al. | 83/399 |

(Continued)

FOREIGN PATENT DOCUMENTS

DE 20118836 2/2002

(Continued)

OTHER PUBLICATIONS

PCT, International Search Report and Written Opinion, PCT/US2007/063128 (Aug. 30, 2007).
PCT, International Preliminary Report on Patentability, PCT/US2007/063128 (Sep. 18, 2008).

*Primary Examiner* — Edward Landrum
(74) *Attorney, Agent, or Firm* — Thompson Hine LLP

(57) ABSTRACT

A food product slicer includes a base and a knife mounted for rotation relative to the base. A carriage assembly is mounted to the base for reciprocal movement back and forth past a cutting edge of the knife. The carriage assembly includes a home position forward of the knife and has a tray arm removably mounted to a carriage arm. An adjustable gauge plate is mounted for movement between a closed position that prevents slicing and multiple open positions that permit slicing at respective thicknesses. An interlock arrangement prevents removal of the tray arm from the carriage arm unless the carriage assembly is in the home position and the gauge plate is in the closed position. The interlock arrangement includes a key member rotatably mounted to the tray arm. A key slot may be located on the carriage arm for receiving an end of the key member.

16 Claims, 9 Drawing Sheets

U.S. PATENT DOCUMENTS 5,687,626 A * 11/1997 Scherch et al. ..... 83/719
6,016,734 A * 1/2000 Koch ..... 83/707
6,209,438 B1 * 4/2001 Mitchell et al. ..... 83/729
7,234,382 B2 * 6/2007 Zhu ..... 83/729
7,637,191 B2 * 12/2009 Zeeb et al. ..... 83/703
7,721,638 B2 * 5/2010 Verhalen et al. ..... 83/718

FOREIGN PATENT DOCUMENTS

EP 0823314 2/1998
EP 0823314 A1 * 2/1998

* cited by examiner

FOOD PRODUCT SLICER AND ASSOCIATED INTERLOCK SYSTEM

CROSS-REFERENCES

This application claims the benefit of U.S. provisional application Ser. No. 60/780,423, filed Mar. 8, 2006.

TECHNICAL FIELD

This application relates generally to a food product slicer having an interlock mechanism, and more particularly, to a slicer having an interlock mechanism that prevents the tray arm of the slicer from being uncoupled from the slicer when the slicer is not in a specific configuration.

BACKGROUND

Commercial food product slicers are widely utilized as rapid and effective devices for slicing meat, cheese, vegetables and other food products. The slicers commonly include a rotatable, disc-like blade, and a reciprocating tray that brings the food product into contact with the rotating blade to cut a slice from the food product. Most slicers also include a movable gauge plate that adjusts the position of the food product relative to the blade, which varies the thickness of the slices cut off the food product. The gauge plate typically has a "closed" position, wherein the gauge plate is slightly raised above the blade such that the food product cannot be cut by the blade.

It is often desired to remove the tray from the slicer body to clean food, fat, or other debris off the tray. Once the tray is removed from the slicer, it is typically carried to a sink for rinsing and cleaning. Many slicers use an interlock mechanism to ensure that the tray can only be removed from the slicer when the gauge plate is in its closed position, and when the tray is in its home position.

SUMMARY

In one aspect, a food product slicer includes a base and a knife mounted for rotation relative to the base. A carriage assembly is mounted to the base for reciprocal movement back and forth past a cutting edge of the knife. The carriage assembly includes a home position forward of the knife and has a tray arm removably mounted to a carriage arm. An adjustable gauge plate is mounted for movement between a closed position that prevents slicing and multiple open positions that permit slicing at respective thicknesses. An interlock arrangement prevents removal of the tray arm from the carriage arm unless the carriage assembly is in the home position and the gauge plate is in the closed position. The interlock arrangement includes a key member rotatably mounted to the tray arm. A key slot may be located on the carriage arm for receiving an end of the key member.

In another aspect, a food product slicer includes a base and a knife mounted for rotation relative to the base. A carriage assembly is mounted to the base for reciprocal movement back and forth past a cutting edge of the knife, the carriage assembly including a home position forward of the knife. The carriage assembly includes a tray arm mounted to a carriage arm, the tray arm removable from the carriage arm. An adjustable gauge plate mounted for movement between a closed position that prevents slicing and multiple open positions that permit slicing at respective thicknesses. An interlock arrangement prevents removal of the tray portion unless the carriage assembly is in the home position and the gauge plate is in the closed position. The interlock arrangement includes an interlock shaft, a carriage interlock member and a gauge plate interlock member. Rotation of the interlock shaft effects movement of both the carriage interlock member and the gauge plate interlock member between respective non-interlocking and interlocking positions.

DETAILED DESCRIPTION

Figure 1:
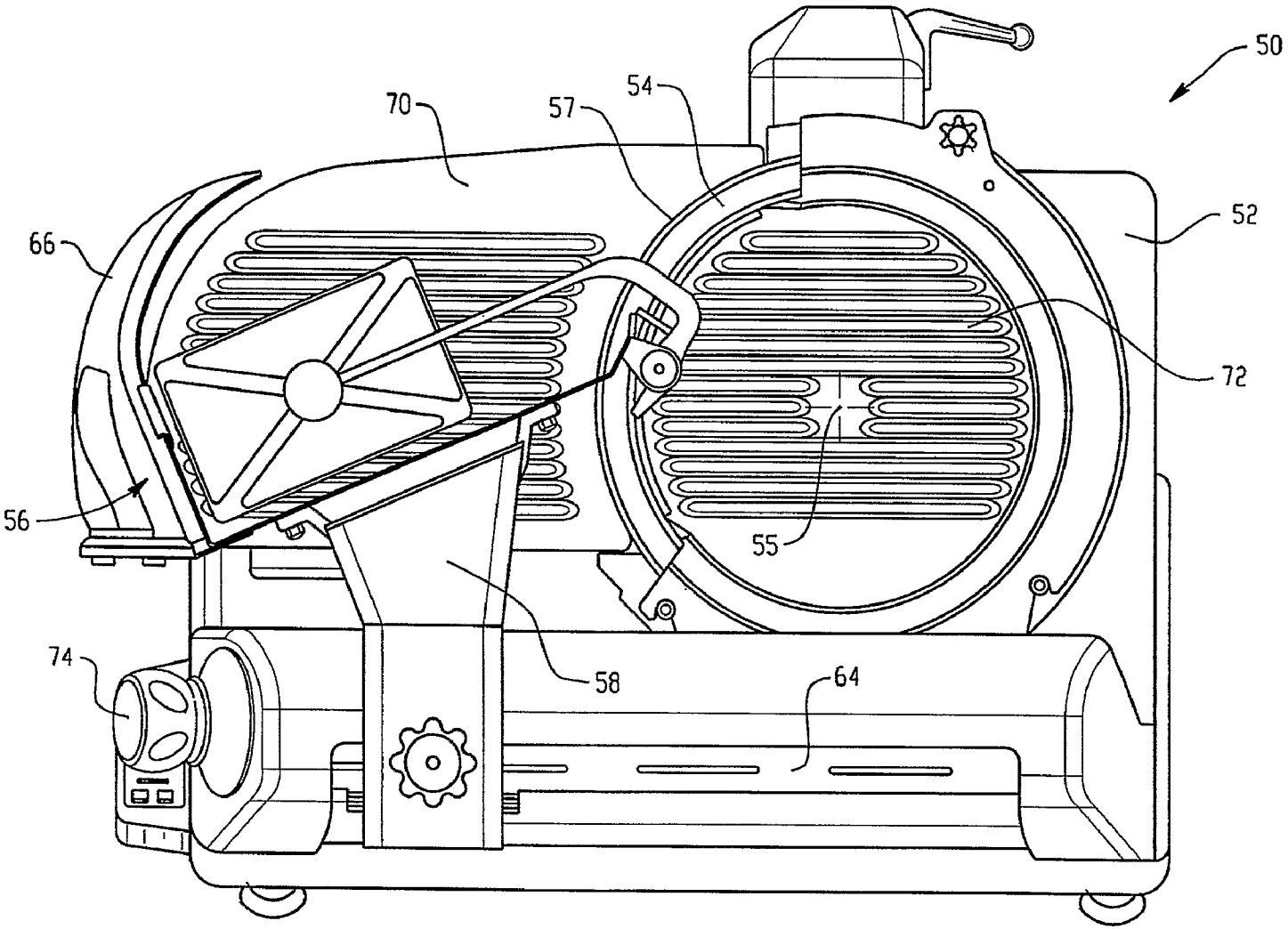
FIG. 1 is side elevation of a food product slicer.

Referring to FIG. 1, a food product slicer 50 includes a housing or base 52 and a circular, motor-driven slicing knife 54 that is mounted to the housing for rotation about an axis 55. The left side of FIG. 1 is generally referred to as the front side of the slicer (which is where an operator stands for slicing), the right side of FIG. 1 is generally referred to as the rear side of the slicer and FIG. 1 depicts a right side view of the slicer. A food product can be supported on a manually operable food carriage 56 which moves the food product to be sliced past the cutting edge 57 of the rotating slicing knife 54. The food carriage 56 reciprocates from left to right relative to FIG. 1, along a linear path so that the lower end of the bulk food product slides along the surface of the gauge plate 70, is cut by the knife 54 and then slides along a knife cover plate 72. Food carriage 56 includes a tray mounted on a tray arm 58 that orients the food carriage tray at the appropriate angle (typically perpendicular) to the cutting edge plane. The food carriage reciprocates in a slot 64 at a lower portion of the housing 52 and a handle 66 is mounted to the food carriage 56. The handle is graspable by a user and can be used to manually move the food carriage. The carriage may also be automatically driven (e.g., as by a motor drive or other prime mover). A handle 74 for adjusting the gauge plate to control slice thickness is also shown.

Figure 2:
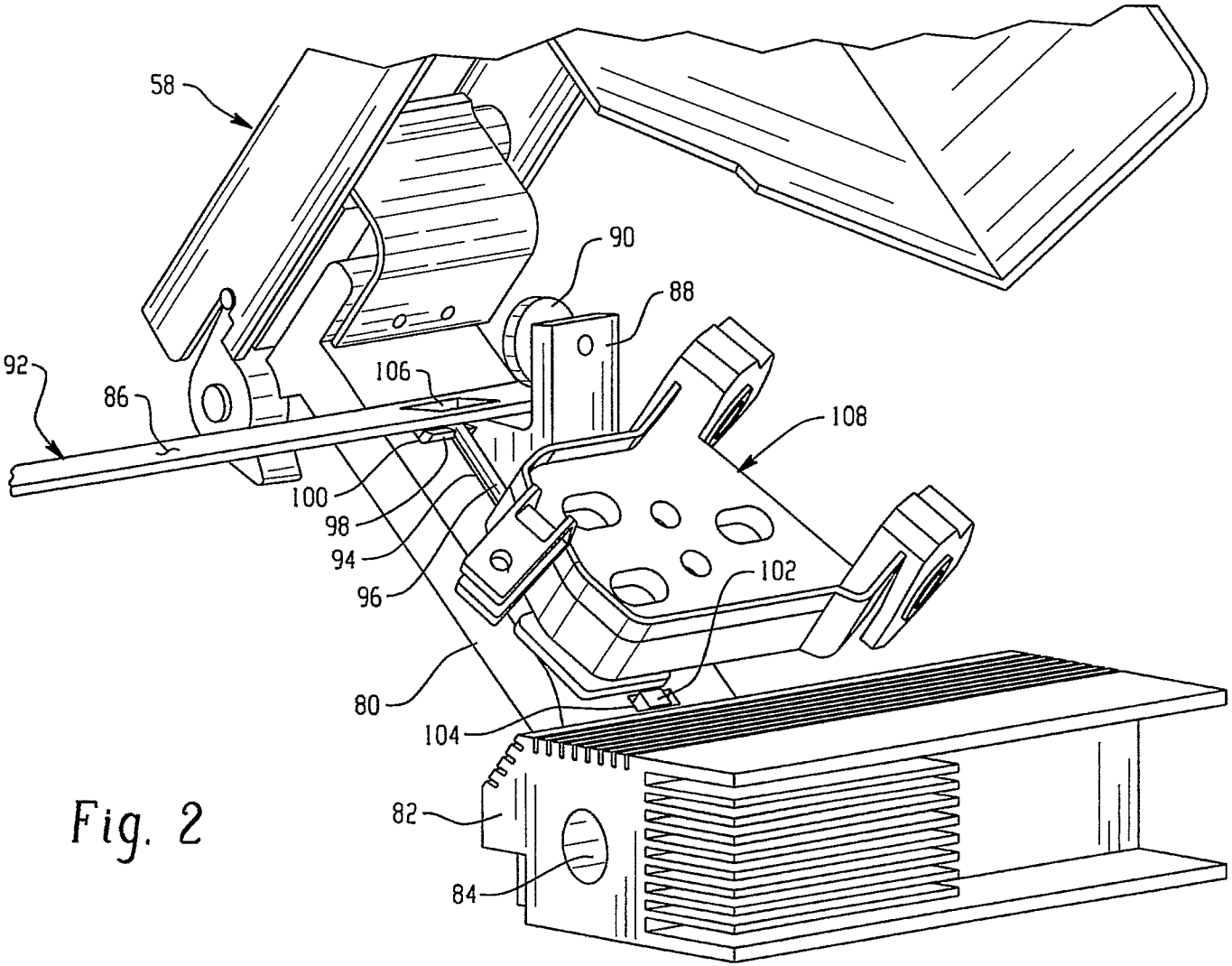
FIG. 2 is a partial perspective of one embodiment of a carriage arm arrangement with interlock members in non-blocking positions.

Referring to FIG. 2, a view of the lower end of the tray arm 58 assembled with a carriage arm 80 is shown, with the body of the slicer absent for clarity. The internal end of the carriage arm 80 is connected with the carriage body 82 that has an opening 84 therethrough for movement along a stationary support shaft (not shown). In one example the carriage body may simply be a tubular metal body member that is driven by some type of belt or linkage drive associated with a rotary motor. In another example the carriage body may be formed by the armature of a linear motor, where the support shaft or rod on which the carriage body moves forms the stator of the linear motor. The outer end of the carriage arm 80 would be arranged to protrude from the slot 64 of the base 52 (FIG. 1).

Referring again to FIG. 2, a carriage arm support surface 86 extends along the movement length of the carriage, with the carriage arm including an extension 88 and associated rolling wheel 90 that rides on the support surface, preventing rotation of the carriage body 82 about the support shaft under the force of gravity. In the illustrated embodiment the support surface is formed by the upper side of an elongated, flat, stationary bar 92 that can be fixed to the base of the slicer.

The carriage arm 80 includes an elongated slot 94 therein with an interlock shaft 96 rotatably positioned therein. Toward an upper end of the shaft 96 an interlock member 98 is positioned in an upper slot 100 and toward a lower end of the shaft 96 an interlock member 102 is positioned in a lower slot 104. Rotation of the interlock shaft 96 causes the interlock members to move between the recessed, non-interlocking positions show in FIG. 2 and the protruding, interlocking positions shown in FIG. 3. The interlock members may be generally block shaped as shown, but could readily have some other suitable configuration. In the interlocking position interlock member 98 moves upward through a slot 106 in bar 92. Thus, if the carriage arm 80 is not in position such that the interlock member 98 is aligned with the slot 106, the interlock shaft cannot be rotated into the position show in FIG. 3. The slot 106 is located so that the interlock member 98 aligns with the slot 106 when the carriage arm 80 is in the most forward position, commonly referred to as the home position, to place the tray furthest from the slicing knife (i.e., the left most position in the view of FIG. 1).

Figure 3:
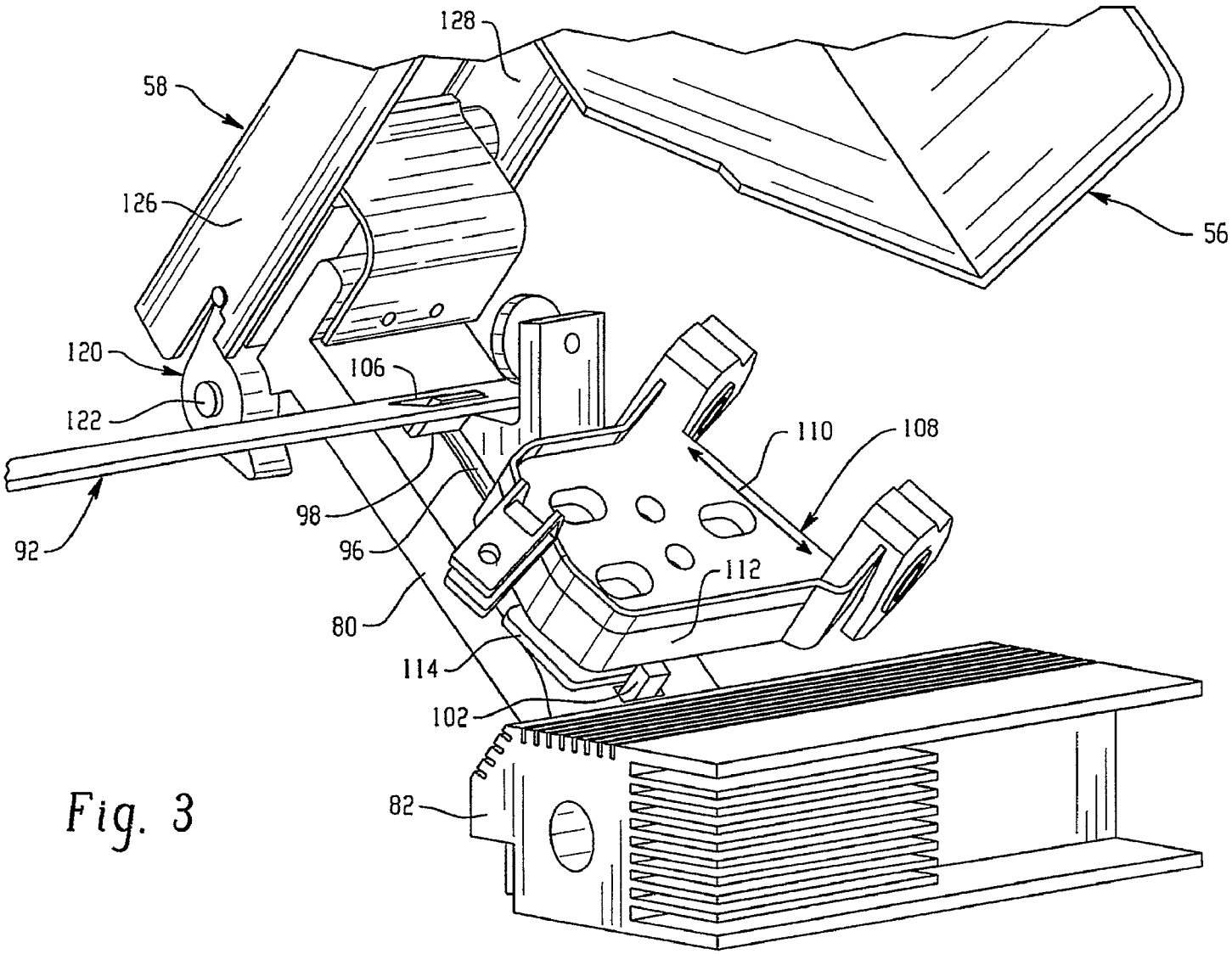
FIG. 3 is a partial perspective of the embodiment of FIG. 2 with the interlock members in blocking positions.

Referring again to FIGS. 2 and 3, an index slider 108 is also shown and is mounted for movement back and forth along a linear path generally reflected by arrow 110. The slicer gauge plate 70 is connected with the index slider such that movement of the index slider 108 moves the gauge plate position to adjust slice thickness. In FIG. 3 the index slider is shown in its zero position (i.e., the position corresponding to gauge plate being located in its "closed" position relative to the edge of the slicer blade so that slicing will not take place). In FIG. 3 the zero position is the most leftward and upward position of the index slider along the slider movement path/direction 110. With the index slider in the zero position the interlock member 102 is able to rotate upward and alongside an edge 112 of the index slider 108, or alongside a plate 114 coupled to and beneath the index slider, thereby blocking movement of the index slider out of the zero position. Likewise, if the index slider is not in its zero position, the upward movement of the interlock member 102 will be impeded by the bottom side of the index slider, or the bottom side of the plate 114, preventing rotation of the interlock shaft 96 into the position shown in FIG. 3.

Thus, as noted from the above description, rotation of the interlock shaft is prevented unless the carriage 82 and carriage arm 80 are in the home position and the index slider 108 is in its zero position (placing the gauge plate 70 in the closed position).

Figure 4:
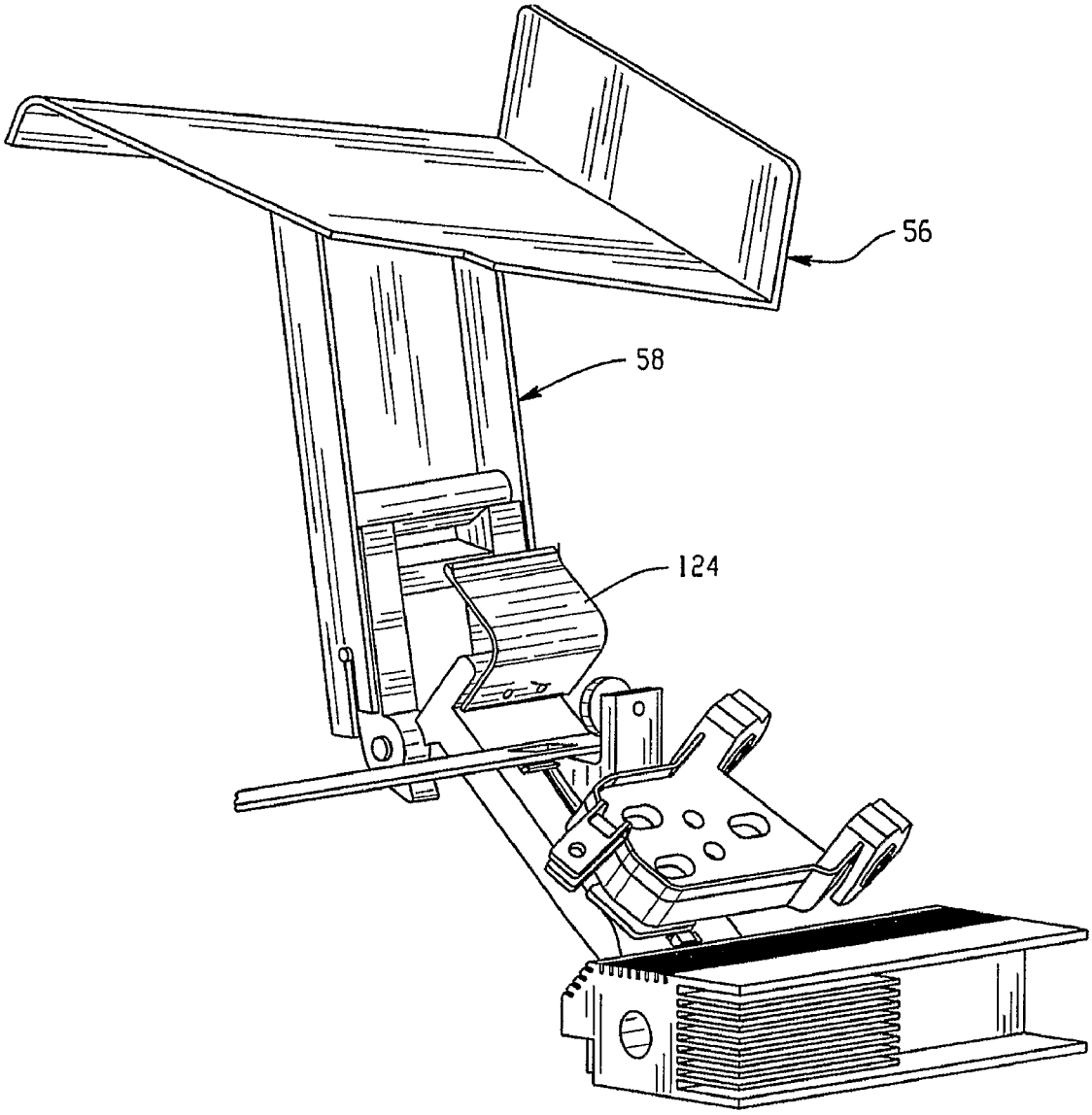
FIG. 4 is a perspective view of the embodiment of FIG. 2 with the tray arm pivoted away from the carriage arm.
Figure 5:
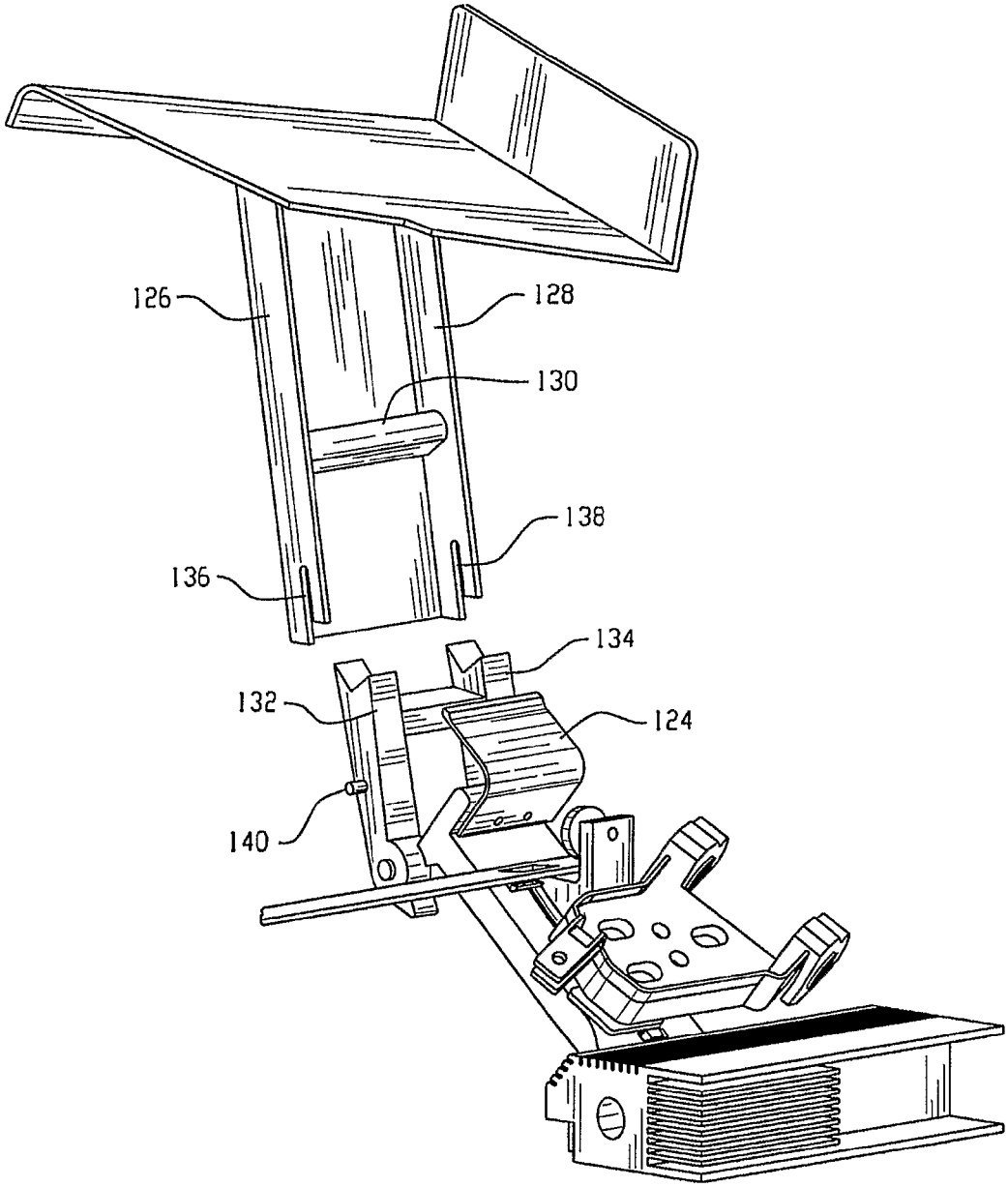
FIG. 5 is a perspective view of the embodiment of FIG. 2 with the tray arm removed from the carriage arm.

As shown in FIG. 3, a pivot block 120 is pivotally connected to the upper end of the carriage arm 80 via a pivot shaft 122. A spring clamp 124 is fastened to the carriage arm 80 and includes an upper leg that extends into a gap between spaced apart walls 126, 128 of the carriage arm 58. As best seen in FIGS. 4 and 5, a mount arm 130 extends between arm walls 126 and 128. An upper side of pivot block 120 includes spaced apart arms 132, 134 having V-shaped notches at their upper ends. The lower side of mount arm 130 is correspondingly shaped for seating in the V-shaped notches. When the tray arm 56 is mounted on the pivot block and the pivot block is rotated into the operating position of FIG. 3, the spring clamp 124 extends over the mount arm 130 and holds the tray arm 56 into its mounted position on the pivot block 120. The walls 126 and 128 of the tray arm 56 include respective slots 136, 138 for receiving mount pins 140 that extend from the side of the pivot block 120.

As shown, the interlock members 98 and 102 are connected for rotation with the interlock shaft. In an alternative embodiment of FIGS. 6-9, and with specific reference to FIG. 9, the interlock shaft 96 includes an elongated slot 170 that interacts with linearly movable pins 172 and 174 within pin housings 176 and 178 in a cam arrangement to move the pins upward when the interlock shaft is rotated in one direction and to pull the pins downward when the interlock shaft is rotated back in the other direction. The pin bodies 176 and 178 may be mounted to the underside of the carriage arm 80 with respective upper sections 180 and 182 positioned within openings in the carriage arm, as generally depicted with respect to pin body 176 in FIG. 7.

Figure 6:
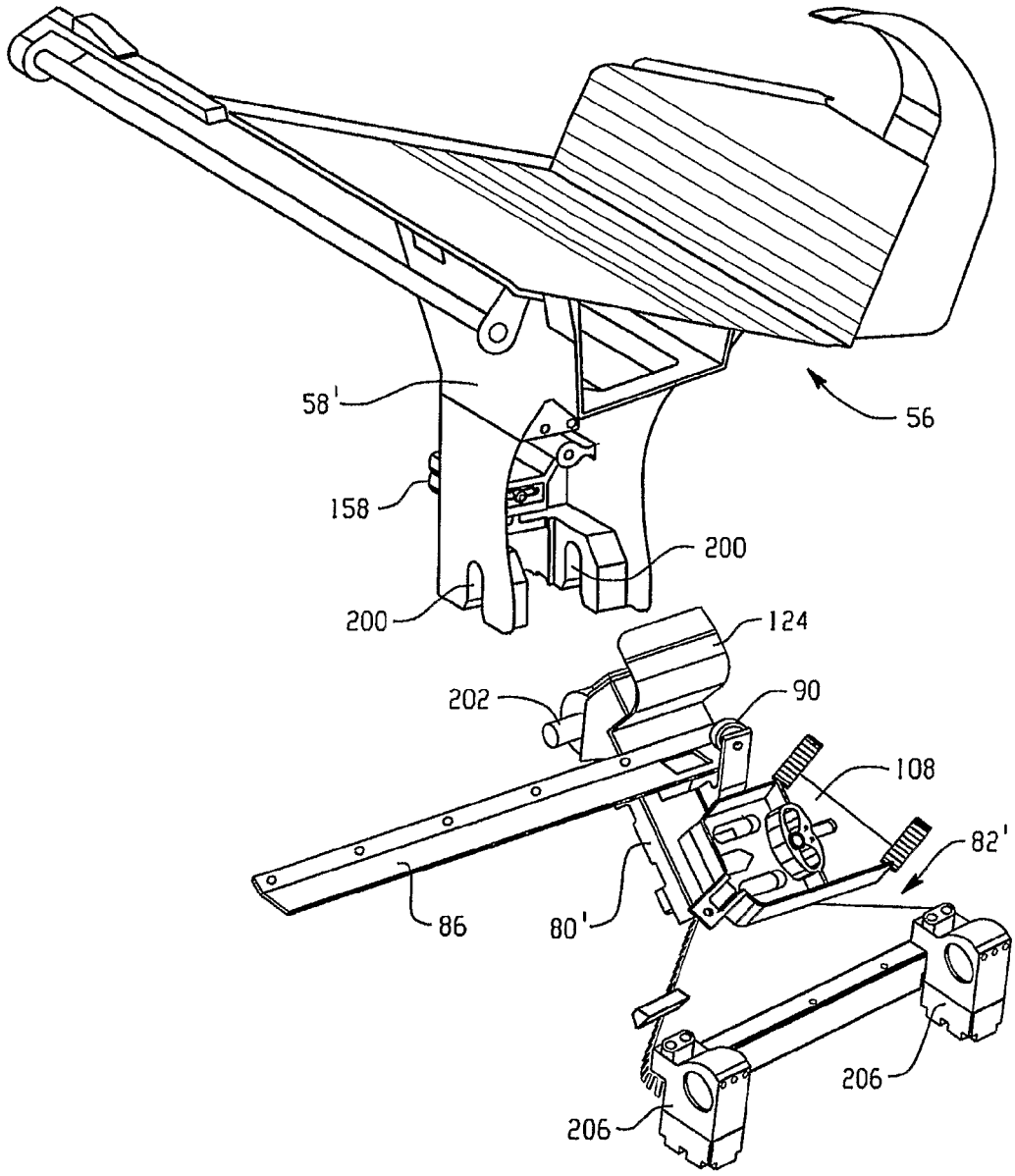
FIG. 6 is a perspective view of another embodiment with the tray arm removed from the carriage arm.
Figure 7:
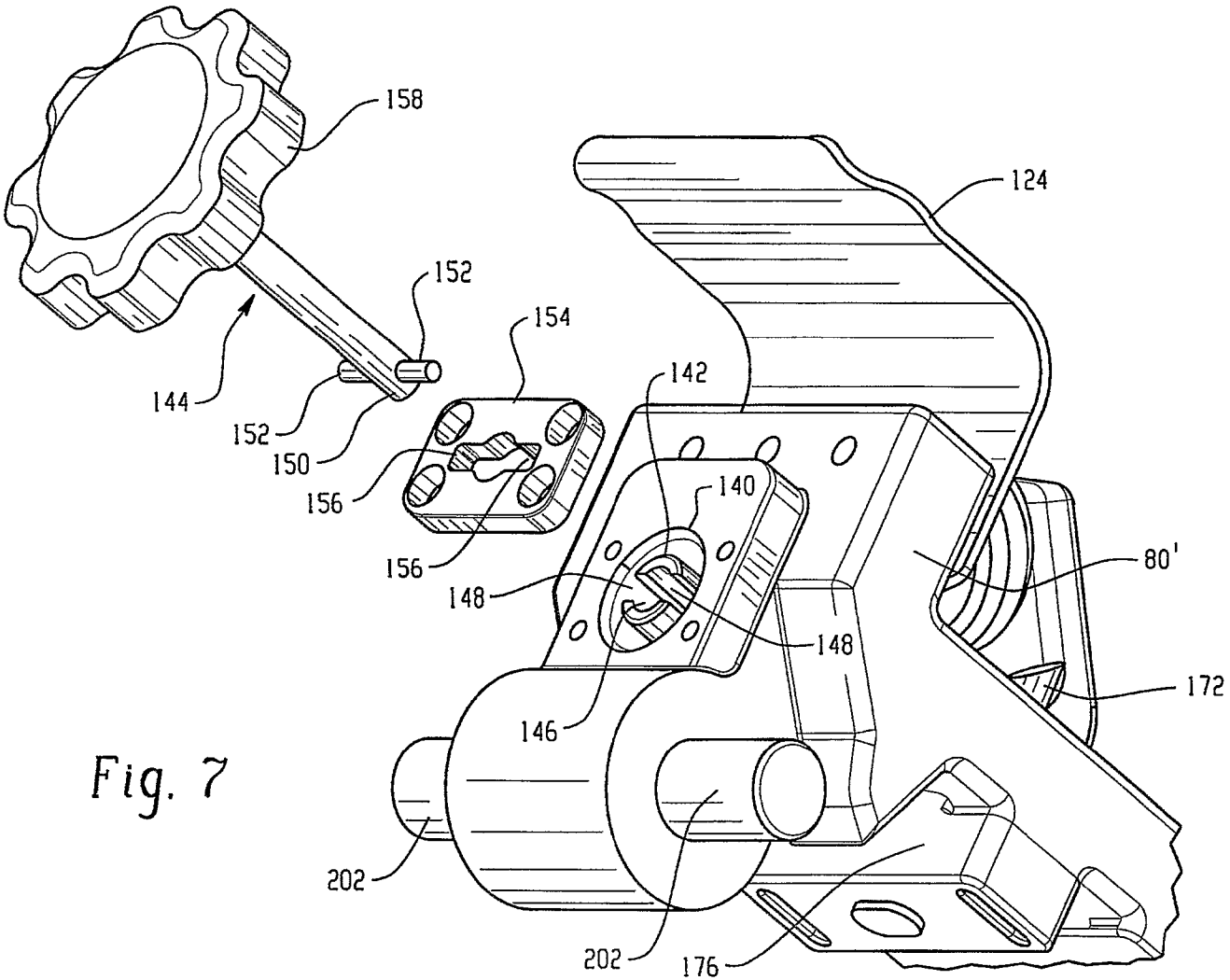
FIG. 7 is a perspective view of the outer end of the carriage arm of FIG. 6.
Figure 8:
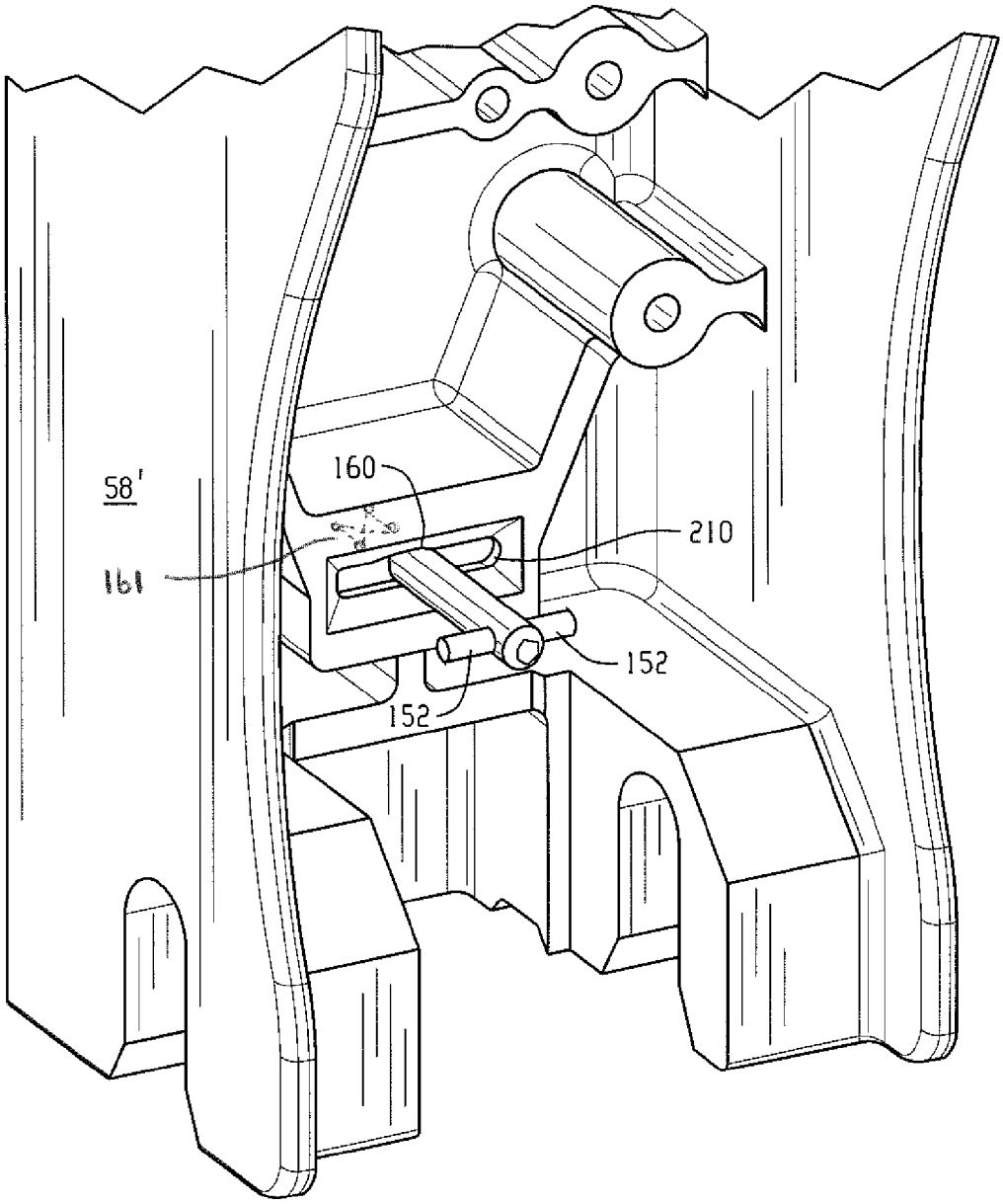
FIG. 8 is a partial perspective view of the lower end of the tray arm of FIG. 6.
Figure 9:
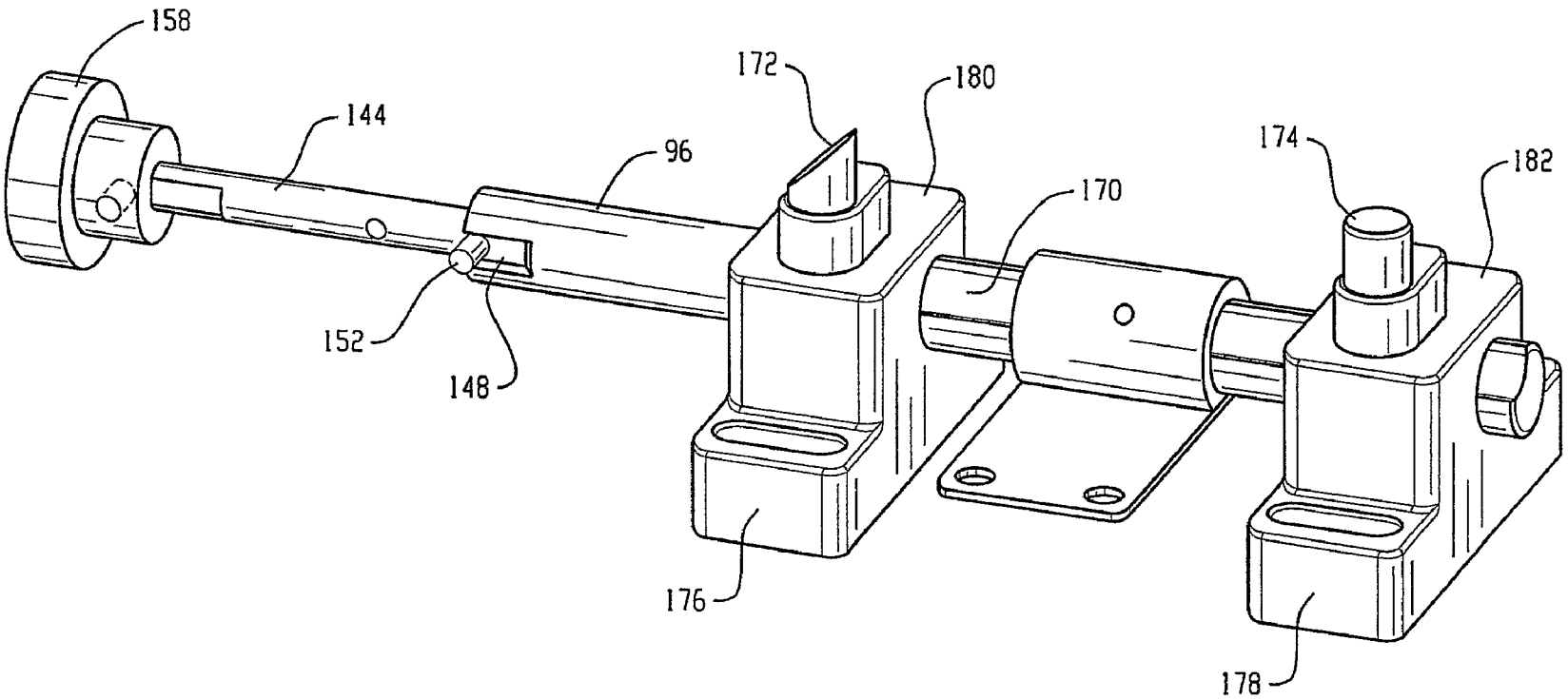
FIG. 9 is a perspective view of the interlock shaft arrangement of FIG. 6 separated from the carriage arm.

As best seen in FIG. 6, tray arm 58' includes a lower end with spaced apart slots 200 located for pivotal mounting on pins 202 located at the upper end of carriage arm 80'. Carriage body 82' includes spaced apart bearing members 206. The protruding end of the carriage arm 80' is shown in FIG. 7 with an opening 140 therein, by which the end 142 of the interlock shaft 96 can be accessed via a key member 144. As shown, the shaft end 142 includes an opening 146 and diametrically opposed keyway slots 148 that receive the central portion 150 and opposed pin portions 152 of the end of the key member. Thus, the key member 144 can be used to rotate the interlock shaft. A keeper plate 154 can be secured to the end of the carriage arm 80' so that the end of the key member can only be inserted into or removed from the end of the carriage arm 80' when the pins 152 align with the keyway slots 156 of the keeper plate, which occurs when the interlock shaft has been rotated to raise the two interlock members 172 and 174. The key member 144 includes a handle 158 to facilitate rotation. As best seen in FIGS. 6 and 8, the key member 144 may be assembled with the lower end of the tray arm 58', with the handle 158 positioned to the outer side of the tray arm. The handle 158 and pins 152 prevent the key member from separating from the tray arm 58', but the key member can rotate relative to, and move axially along the opening 160.

When the key member is rotated to move the interlock shaft so that interlock members 172 and 174 are moved downward to the non-interlocking positions, the offset position of the pins 152 and slots 156 will prevent the key member from retracting through the keeper plate 154, and the interaction between the handle end of the key member 144 and the tray arm 58' will prevent the tray arm 58' from pivoting out of the operating position. The back side of the keeper plate 154 may also include detent features to help assure the handle does not rotate out of such position inadvertently. When the key member is rotated (e.g., overcoming the detent restriction) to move the interlock shaft so that interlock members 172 and 174 are moved upward to the interlocking positions, the pins 152 will align with the slots 156 of the keeper plate opening permitting the key end of the key member to retract through the keeper plate opening so that the tray arm can be pivoted away from the end of the carriage arm and then lifted off of the carriage arm.

The key member 144 may be mounted to the tray arm 58' with a biasing feature (e.g., a spring 161 arranged to urge movement of the key member toward the outer side of the tray arm) that causes the pins 152 to be pulled into a slot 210 (FIG. 8) of the tray arm 58' when the tray arm is tilted away and/or removed from the carriage arm 80' so that the pins 152 remain in proper position for alignment with the keeper slots 156 when desired to move the tray arm 58' back into the operating position. Once the tray arm 58' is moved back to the operating position, the key member is pressed axially into and through key slot to engage the end of the interlock shaft, and is rotated to rotate the interlock shaft and lower the interlock members 102 and 104. The carriage assembly and gauge plate cannot be moved out of their respective home and closed positions until the key member has effected such rotation of the interlock shaft and lowering of the interlock members.

The embodiment of FIGS. 2-5 could include a similar key, keeper plate and end interlock shaft arrangement as that described for the embodiment of FIGS. 6-9.

It is to be clearly understood that the above description is intended by way of illustration and example only and is not intended to be taken by way of limitation. For example, the end of the key member (and corresponding keeper plate slot and interlock shaft end) could take on various other configurations. Moreover, the key member could be arranged to interact with a component other than an interlock shaft, with such component arranged to directly or indirectly move the interlock members. Other changes and modifications could be made.

What is claimed is:

1. A food product slicer, comprising:

a base;

a knife mounted for rotation relative to the base;

a carriage assembly mounted to the base for reciprocal movement back and forth past a cutting edge of the knife, the carriage assembly including a home position forward of the knife, the carriage assembly including a removable tray portion;

an adjustable gauge plate mounted for movement between a closed position that prevents slicing and multiple open positions that permit slicing at respective thicknesses; and an interlock arrangement for preventing removal of the tray portion unless the carriage assembly is in the home position and the gauge plate is in the closed position, the interlock arrangement including an interlock shaft, a carriage interlock member and a gauge plate interlock member, rotation of the interlock shaft effects movement of both the carriage interlock member and the gauge plate interlock member between respective non-interlocking and interlocking positions;

wherein the carriage interlock member is arranged for movement into a position to block movement of a carriage arm support wheel and the gauge plate interlock member is arranged for movement into a position to block movement of an index slider that is operatively connected to the gauge plate.

2. The slicer of claim 1 wherein the tray portion includes a tray connected with a tray arm, the tray arm removably connected to a carriage arm of the carriage assembly, the interlock shaft associated with the carriage arm.

3. The slicer of claim 2 wherein the interlock shaft passes through a first pin housing and a second pin housing, the first and second pin housings mounted to the carriage arm, the first pin housing containing a movable pin that forms the carriage interlock member, the second pin housing contains a second movable pin that forms the gauge plate interlock member.

4. The slicer of claim 1 wherein the carriage interlock member and the gauge plate interlock member rotate with the interlock shaft.

5. The slicer of claim 1 wherein the interlock arrangement further includes a key member rotatably mounted to the tray portion.

6. A food product slicer, comprising:

a base;

a knife mounted for rotation relative to the base;

a carriage assembly mounted to the base for reciprocal movement back and forth past a cutting edge of the knife, the carriage assembly including a home position forward of the knife, the carriage assembly including a removable tray portion;

an adjustable gauge plate mounted for movement between a closed position that prevents slicing and multiple open positions that permit slicing at respective thicknesses; and an interlock arrangement for preventing removal of the tray portion unless the carriage assembly is in the home position and the gauge plate is in the closed position, the interlock arrangement including an interlock shaft, a carriage interlock member and a gauge plate interlock member, rotation of the interlock shaft effects movement of both the carriage interlock member and the gauge plate interlock member between respective non-interlocking and interlocking positions;

wherein the interlock arrangement further includes a key member rotatably mounted to the tray portion;

wherein an end of the key member is configured for matingly engaging an end of the interlock shaft such that rotation of the key member effects rotation of the interlock shaft.

7. The slicer of claim 6 wherein the key member remains with the tray portion when the tray portion is removed from the carriage assembly.

8. A food product slicer, comprising:

a base;

a knife mounted for rotation relative to the base;

a carriage assembly mounted to the base for reciprocal movement back and forth past a cutting edge of the knife, the carriage assembly including a home position forward of the knife, the carriage assembly including a tray arm mounted to a carriage arm, the tray arm removable from the carriage arm;

an adjustable gauge plate mounted for movement between a closed position that prevents slicing and multiple open positions that permit slicing at respective thicknesses; and an interlock arrangement for preventing removal of the tray arm from the carriage arm unless the carriage assembly is in the home position and the gauge plate is in the closed position, the interlock arrangement including a key member rotatably mounted to the tray arm;

wherein the interlock arrangement further includes a key slot located on the carriage arm for receiving an end of the key member;

wherein the key slot leads to an interlock shaft configured to receive the end of the key member, rotation of the interlock shaft moves a carriage interlock member and a gauge plate interlock member.

9. The slicer of claim 8 wherein the interlock shaft passes through a first pin housing and a second pin housing, the first and second pin housings mounted to the carriage arm, the first pin housing containing a movable pin that forms the carriage interlock member, the second pin housing contains a second movable pin that forms the gauge plate interlock member.

10. The slicer of claim 8 wherein the carriage interlock member and the gauge plate interlock member rotate with the interlock shaft.

11. The slicer of claim 8, wherein the carriage interlock member is arranged for movement into a position to block movement of a carriage arm support wheel and the gauge plate interlock member is arranged for movement into a position to block movement of an index slider that is operatively connected to the gauge plate.

12. The slicer of claim 8 wherein a keeper plate is located on the carriage arm and includes the key slot, the end of the key member and the key slot are cooperatively configured to prevent the end of the key member from withdrawing from the key slot when the key member is rotated to place the interlock shaft in a position in which the carriage interlock member and the gauge plate interlock member permit movement of both the carriage assembly and the gauge plate.

13. The slicer of claim 12 wherein the key member and key slot are cooperatively configured to permit the end of the key member to withdraw from the key slot when the key member is rotated to place the interlock shaft in a position in which the carriage interlock member and the gauge plate interlock member prevent movement of the carriage assembly and the gauge plate out of the respective home position and closed position.

14. The slicer of claim 8 wherein the key member is rotatably mounted in an opening of the tray arm, a shaft of the key member is movable axially through the opening, and the key member is biased toward an outer side of the tray arm.

15. The slicer of claim 8 wherein the tray arm is pivotally mounted to the carriage arm for tilting away from the gauge plate.

16. The slicer of claim 8 wherein the end of the key member includes a pair of diametrically opposed pins.

* * * * *